US010272280B2

(12) United States Patent
Leonardi et al.

(10) Patent No.: US 10,272,280 B2
(45) Date of Patent: Apr. 30, 2019

(54) BRAKING SYSTEM FOR GYMNASTIC MACHINES AND OPERATING METHOD THEREOF

(71) Applicant: TECHNOGYM S.P.A., Cesena (IT)

(72) Inventors: Andrea Leonardi, Cesena (IT); Guido Nenna, Cesena (IT); Marco Magnarosa, Cesena (IT)

(73) Assignee: TECHNOGYM S.P.A., Cesena (IT)

( * ) Notice: Subject to any disclaimer, the term of this patent is extended or adjusted under 35 U.S.C. 154(b) by 42 days.

(21) Appl. No.: 15/434,552

(22) Filed: Feb. 16, 2017

(65) Prior Publication Data

US 2018/0229065 A1 Aug. 16, 2018

(51) Int. Cl.
*A63B 21/00* (2006.01)
*A63B 21/22* (2006.01)
(Continued)

(52) U.S. Cl.
CPC .... *A63B 21/0052* (2013.01); *A63B 21/00192* (2013.01); *A63B 21/225* (2013.01);
(Continued)

(58) Field of Classification Search
CPC ..... A63B 21/00058; A63B 21/00069; A63B 21/00192; A63B 21/005; A63B 21/0051; A63B 21/0052; A63B 21/22; A63B 21/225; A63B 21/4049; A63B 22/0046; A63B 22/06; A63B 22/0605; A63B 24/0062; A63B 24/0087; A63B 2024/0068;
(Continued)

(56) References Cited

U.S. PATENT DOCUMENTS 4,875,674 A * 10/1989 Dreissigacker ..... A63B 21/153 482/72
5,165,278 A * 11/1992 Huszczuk ..... A61B 5/221 482/900
(Continued)

FOREIGN PATENT DOCUMENTS

WO WO 2006/107266 A2 10/2006

OTHER PUBLICATIONS

Italian Search Report and Written Opinion issued in Italian Patent Application No. ITUB20159645 dated Aug. 4, 2016.

*Primary Examiner* — Gary D Urbiel Goldner
(74) *Attorney, Agent, or Firm* — Arent Fox LLP

(57) ABSTRACT

A braking system for gymnastic machines having one rotating member, as a flywheel, on which magnetic braking members are arranged, and operating methods thereof. The system comprises a magnetic sensor for detecting the magnetic field intensity induced from the braking members on the flywheel, and a sensor for measuring the rotation velocity of the flywheel. The braking system comprises also a second magnetic sensor, arranged at a predetermined distance from the first magnetic sensor, to measure the magnetic field induced on the flywheel as conditioned by the structure of the gymnastic machine, and a temperature sensor, arranged in correspondence of the first magnetic sensor, to detect the temperature of the flywheel. The system comprises a control logic unit, operatively connected to the first and second magnetic sensor, to the temperature sensor and to the angular velocity sensor.

2 Claims, 3 Drawing Sheets

(51) Int. Cl.
*A63B 22/06* (2006.01)
*A63B 24/00* (2006.01)
*A63B 21/005* (2006.01)

(52) U.S. Cl.
CPC ..... *A63B 22/0605* (2013.01); *A63B 24/0062* (2013.01); *A63B 24/0087* (2013.01); *A63B 2220/34* (2013.01); *A63B 2220/72* (2013.01); *A63B 2220/833* (2013.01); *A63B 2220/89* (2013.01)

(58) Field of Classification Search
CPC ..... A63B 69/16; A63B 71/0054; A63B 2071/0072; A63B 2220/34; A63B 2220/35; A63B 2220/36; A63B 2220/44; A63B 2220/54; A63B 2220/58; A63B 2220/72; A63B 2220/80; A63B 2220/803; A63B 2220/83; A63B 2220/833; A63B 2220/89; A63B 2225/20; A63B 2225/50; A63B 2225/52; A63B 2225/54
See application file for complete search history.

(56) References Cited

U.S. PATENT DOCUMENTS 5,351,555 A * 10/1994 Garshelis ..... G01L 3/102 336/30
5,520,059 A * 5/1996 Garshelis ..... G01L 3/102 73/862.333
5,785,630 A * 7/1998 Bobick ..... A63B 22/16 482/1
5,890,995 A * 4/1999 Bobick ..... A63B 24/0084 482/4
6,485,397 B1 * 11/2002 Manderbacka .... A63B 21/0051 482/57
6,513,395 B1 2/2003 Jones
9,314,667 B2 * 4/2016 Puerschel ..... A63B 24/0087
9,839,807 B2 * 12/2017 Golesh ..... A63B 21/00069
9,839,810 B1 * 12/2017 Tzeng ..... A63B 21/00072
2006/0003872 A1 * 1/2006 Chiles ..... A63B 21/225 482/57
2006/0234840 A1 * 10/2006 Watson ..... A63B 24/00 482/61
2007/0123390 A1 * 5/2007 Mathis ..... A63F 13/06 482/8
2008/0096725 A1 * 4/2008 Keiser ..... A63B 21/0051 482/8
2008/0207402 A1 8/2008 Fisher et al.
2010/0234185 A1 * 9/2010 Watt ..... A63B 21/0051 482/8
2011/0048141 A1 * 3/2011 Svenberg ..... A63B 21/015 73/862.191
2011/0111923 A1 * 5/2011 Bacanovic ..... A63B 22/0605 482/8
2011/0118086 A1 * 5/2011 Radow ..... A63B 21/00196 482/5
2011/0152039 A1 6/2011 Hendrickson et al.
2011/0195818 A1 8/2011 Schroeder et al.
2012/0214646 A1 * 8/2012 Lull ..... G01L 3/242 482/5
2013/0059698 A1 * 3/2013 Barton ..... A63B 71/0622 482/63
2014/0106936 A1 * 4/2014 Puerschel ..... A63B 21/0051 482/6
2014/0113779 A1 * 4/2014 Loach ..... A63B 21/0004 482/115
2014/0171266 A1 * 6/2014 Hawkins, III ..... A63B 24/0087 482/5
2014/0171272 A1 * 6/2014 Hawkins, III ..... A63B 24/0087 482/61
2014/0243171 A1 * 8/2014 Huang ..... A63B 21/225 482/118
2014/0274600 A1 * 9/2014 Dalebout ..... A63B 21/225 482/115
2016/0144223 A1 * 5/2016 Dalebout ..... A63B 22/0076 482/72
2016/0256731 A1 * 9/2016 Tseng ..... A63B 21/225
2016/0310785 A1 * 10/2016 Lo ..... A63B 21/005
2017/0036053 A1 * 2/2017 Smith ..... A63B 21/015
2017/0106222 A1 * 4/2017 Mayer ..... F16D 55/2245
2017/0128764 A1 * 5/2017 Hsu ..... A63B 69/16
2018/0008856 A1 * 1/2018 Radow ..... A63B 21/0052
2018/0036586 A1 * 2/2018 Cristofori ..... A63B 22/0025
2018/0117401 A1 * 5/2018 Chen ..... A63B 24/0062

* cited by examiner

BRAKING SYSTEM FOR GYMNASTIC MACHINES AND OPERATING METHOD THEREOF

The present invention relates a braking system for gymnastic machines and operating method thereof.

More specifically, the invention concerns a system of the above kind, studied and realized in particular for decelerate a gymnastic machine, on which it is installed, generating eddy currents by electromagnetic induction without physical contact between the system and the gymnastic machine itself.

In the following, the description will be directed to a braking system installed on a passive pedal machine, such as a bicycleergometer or bicyclesimulator or spinning bike and the like, but it is clear that the same should not be considered limited to this specific use.

As it is well known, currently some exercise machines, such as spinning bikes, exercise bike or treadmill, use magnetic or electromagnetic brakes to exert a resistant force to a user's ride or race, who is performing a gymnastic exercise.

Currently the magnetic or electromagnetic brakes consist of a metal conductor disk, called rotor or flywheel, which rotates passing through a magnetic field generated by powered coils or by permanent magnets, which constitute the magnetic brake. Induced voltages are created in the flywheel that generate also eddy currents, known also as Foucault currents. These eddy currents in their turn generate a magnetic field, which, opposing to that of the initial magnetic field generator, perform the braking function.

The braking force induced on the flywheel is controlled by adjusting the supply current of the coils.

Said braking force in the flywheel generates heat, which causes the increase of the temperature of the flywheel itself. This temperature increase reduces the braking force.

In the braking systems currently in use there are also other parameters that affect the braking force. The most important parameters are: the geometry of the structure on which the braking systems are installed, the conductivity of the metal of which the flywheel is made, the thickness of the flywheel itself, the magnetic field direction, the flywheel area intercepted by the magnetic field, the shape of the flywheel and the relative speed between the magnetic field and the flywheel.

Due to said parameters that affect the braking force, current braking systems are individually calibrated for each exercise machine, which they are installed on.

Moreover, in the current braking systems, the braking force acting on the flywheel is only nominally equal to that desired, while actually it can be appreciably different.

It seems apparent that the braking systems according to the prior art are not reliable, since the operation depends on external conditions.

In light of the above, it is, therefore, object of the present invention providing a universal brake system for gymnastic machines, whose developed braking force is independent of the environmental conditions and the structure or geometry of the gymnastic machine, on which the system is installed and from the materials the flywheel is made of.

A further object of the invention is providing a system allowing to perform a direct real time measurement of the induced magnetic field and therefore the braking force acting on the flywheel, compensating the exercise temperature values of the flywheel, the environmental temperature variations and the effects of the secondary environmental and eddy magnetic fields.

Another object of the invention is to provide an operation method, to make the braking force independent from parameters external of the system.

It is therefore specific object of the present invention a braking system, installable on gymnastic passive machines, of the type having one rotating member such as a flywheel and the like, on which magnetic braking members are arranged, capable to generate a magnetic braking force on said flywheel, comprising: a magnetic sensor, arranged in proximity of said magnetic braking members, so as to detect the intensity of the magnetic field induced from said braking members on said flywheel, an angular velocity sensor, for measuring the rotation velocity of said flywheel, characterized in that said braking system comprises a second magnetic sensor, arranged at a predetermined distance, preferably comprised between 5 and 15 cm, from said first magnetic sensor, to measure the magnetic field induced on said flywheel as conditioned by the structure of said gymnastic machines; in that said braking system comprises a temperature sensor arranged in correspondence of said first magnetic sensor, to detect the temperature of said flywheel; and in that said braking system comprises one control logic unit, operatively connected to said first and second magnetic sensor, to said temperature sensor and to said angular velocity sensor, in which nominal calibration values are stored, said control logic unit being capable to acquire and process the electric signals from said first magnetic sensor, from said second magnetic sensor and from said temperature sensor, so as to calculate the actual braking magnetic force generated by said magnetic members on said flywheel, during the operation of said gymnastic machine, correcting said calculation after a comparison between the data acquired from said sensors and said stored nominal calibration values.

Further according to the invention, said first and second magnetic sensor are of Hall effect type.

Preferably according to the invention, said system could be made on a printed circuit board, having a shape which extends substantially longitudinally, so that said first and second magnetic sensor are arranged at the opposite ends of said printed circuit board at said predetermined distance.

It is further object of the present invention an operating method of a braking system, installable on gymnastic passive machines, of the type having one rotating member such as a flywheel and the like, on which magnetic braking members are arranged capable to generate a magnetic braking force on said flywheel, comprising the following operating steps:

providing a measure of the magnetic field intensity induced from said braking members on said flywheel, providing a measure of the rotation velocity of said flywheel, providing a measure of the intensity of the magnetic field induced on said flywheel as conditioned by the structure of said gymnastic machines, providing a measure of the working temperature of said flywheel during the working of said gymnastic machines, providing a control logic unit, comprising a memory support wherein nominal calibration values are stored, said control logic unit being capable to acquire and process the electric signals coming from said sensors, to calculate the braking magnetic actual force generated by said magnetic members on said flywheel during the working of said gymnastic machine, correcting said calculation after a comparison between the data acquired from said sensors and said nominal calibration values stored.

Further according to the invention, the calculation of said magnetic force takes place by the following steps:

storage of one look-up table in said memory support of said control logic unit, comprising nominal calibration values calculated in standard conditions measured on a sample gymnastic machine such as: $d_n$ position of one first magnetic sensor and $RPM_n$, rotation velocity of said flywheel;

detecting the actual rotation velocity RPM of said flywheel of said gymnastic machine, by an angular velocity sensor;

calculation of an actual induced magnetic field $\vec{B}_i^d$ on the flywheel of one gymnastic machine;

comparison of said value of the actual induced magnetic field $\vec{B}_i^d$ and the actual rotation velocity RPM with the nominal calibration values comprised in said look-up table, from which the actual value of the braking force C acting on the flywheel of said gymnastic machine is obtained.

Preferably according to the invention, the calculation of said actual induced magnetic field $\vec{B}_i^d$ takes place by the following formula:

$$\vec{B}_i^d = Tr^{-1}(\vec{B}_{mis}^d - \alpha(T-T_0)\underline{u} - \vec{B}_{off}) - a\vec{B}_s^d$$

wherein Tr is a transformation matrix which takes into account the offset of the position of said magnetic sensor; $\vec{B}_{mis}^d$ is the induced magnetic field measured in said testing step at a preset velocity, wherein the magnetic brake is in the position d; $\alpha(T-T_0)\underline{u}$ is the correction factor in temperature which takes into account the working temperature T, compared to the nominal one T0 of the model, wherein $\alpha$ is the de-rating factor in temperature of said temperature sensor and u is the unitary versor of the frame of reference; $\vec{B}_{off}$ is the offset value of the magnetic induction, measured from said second magnetic sensor; $\vec{B}_S^d$ is the static magnetic field which takes into account the a gymnastic machine own mechanic structure; a is one attenuation factor of said static magnetic field.

Still according to the invention, said value Tr is calculated by the following formula, which is an estimation made during the testing step of the gymnastic machine, by two measurements made at different velocities of rotation of the flywheel, $v_1$ and $v_2$:

$$Tr[\underline{x} - \underline{x}_0] = \frac{\left(\vec{B}_{mis}^d(v_1) - \vec{B}_{mis}^d(v_2)\right)\cdot\left(\vec{B}_i^d(v_1) - \vec{B}_i^d(v_2)\right)^T}{\left\|\vec{B}_i^d(v_1) - \vec{B}_i^d(v_2)\right\|^2}$$

Always according to the invention, said value $\vec{B}_{mis}^d$ is calculated by the following formula:

$$\vec{B}_{mis}^d = \alpha(T-T_0)\underline{u} + \vec{B}_{off} + Tr[\underline{x}-\underline{x}_0]\cdot(a\vec{B}_s^d + \vec{B}_i^d)$$

Further according to the invention, said factor a is calculated by the following formula:

$$a = \frac{\left(Tr[\underline{x} - \underline{x}_0]\cdot\vec{B}_s^d\right)^T\cdot\left(\vec{B}_{mis}^d - \alpha(T-T_0)\underline{u} - \vec{B}_{off}\right)}{\left\|Tr[\underline{x} - \underline{x}_0]\cdot\vec{B}_s^d\right\|^2}$$

Finally according to the invention, said method allows the calculation of the power output by said gymnastic machine by the formula:

$$P = \frac{C\cdot 2\pi\cdot RPM}{60}$$

wherein C is the braking torque exerted by said gymnastic machine, whose value is taken from said look-up table after the measurement of the rotation velocity of the flywheel RPM and the calculation of said actual induced magnetic field.

The present invention will be now described, for illustrative but not limitative purposes, according to its preferred embodiments, with particular reference to the figures of the enclosed drawings, wherein.

In the various figures, similar parts will be indicated by the same reference numbers.

Figure 1:
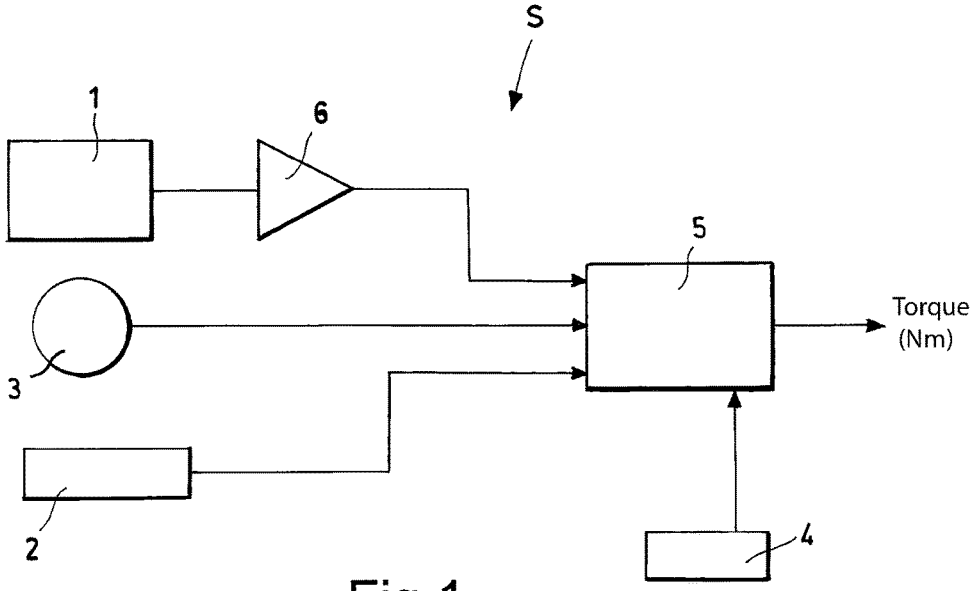
FIG. 1 shows a schematic diagram of the braking system object of the present invention.

The braking system S for gymnastic machines object of the present invention is typically installed on gymnastic machines having a rotating member, such as a flywheel and the like, on which the magnetic brake members are arranged, such as permanent magnets, or electromagnets, or a suitably powered coil, also called magnetic brake, adapted to generate a magnetic field on said flywheel.

In particular, said braking system S comprises essentially a Hall effect first magnetic sensor 1, a Hall effect second magnetic sensor 2, a temperature sensor 3, an angular velocity sensor 4 of the flywheel of the gymnastic machine on which said braking system S is installed, a control logic unit 5 and an amplifier 6 for amplifying the signals coming from said first magnetic sensor 1, to be sent to said control logic unit 5.

Said first magnetic sensor 1 has the function of detecting the intensity of the magnetic field on said flywheel, exploiting the well-known Hall effect, and it is therefore arranged close to said magnetic brake, supported by magnet-holder forks that can structurally differ in different machines. Said first magnetic sensor 1 is connected by said amplifier 6 to said control logic unit 5.

Said second magnetic sensor 2 is placed at a predetermined distance from said first magnetic sensor 1, preferably at a distance between 5 and 15 cm, to detect the magnetic field as influenced by the structure of the gymnastic machine. In fact, generally the gymnastic machines have a metal or metal alloy frame, which therefore modify the magnetic field generated by the magnetic brake in the space. Therefore, the position of said second magnetic sensor 2 is such as to ensure that said second magnetic sensor 2 does not significantly be affected by the magnetic field induced by the magnetic brake, but such as to allow to detect the effect of the structure of the gymnastic machine on said magnetic field induced in the flywheel.

Said temperature sensor 3 is placed close to said first magnetic sensor 1, to detect the flywheel temperature.

Said control logic unit 5 is adapted to acquire and process the electrical signals coming from said first 1 and second 2 magnetic sensors and from said temperature sensor 3, which it is connected to.

Said angular velocity sensor 4 is also connected to to said control logic unit 5, adapted to detect the angular velocity of the flywheel during the execution of the gymnastic exercise by the user.

Figure 2:
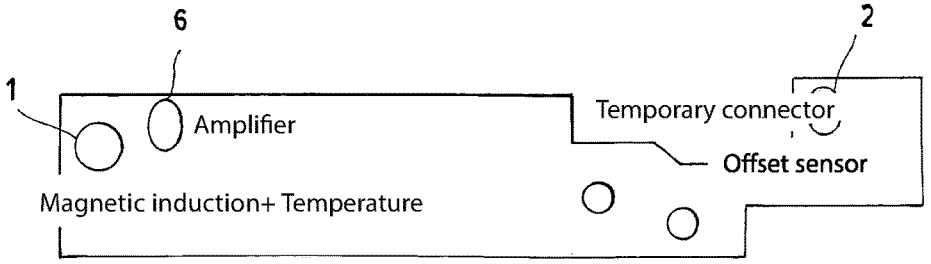
FIG. 2 shows the circuit board of the system of FIG. 1.

FIG. 2 shows the possible implementation of the system shown in FIG. 1 on a printed circuit board. Said printed circuit board has a shape that extends substantially longitudinally. In this way, it is seen that said first 1 and second 2 magnetic sensor are arranged at the opposite ends of said printed circuit board.

The braking torque applied by a magnetic or electromagnetic brake on the flywheel, is directly proportional to the magnetic induction field induced according to the Faraday-Lenz law.

The induced magnetic field is, in its turn, connected to the rotation velocity of the flywheel, indicated with RPM, to the insertion depth of the magnetic brake, i.e. to the distance $(d_x,d_y,d_z)^T$, indicated with $\vec{d}$, between the magnetic brake and said first magnetic sensor 1, and to the magnetization strength of the permanent magnets that constitute the brake, indicated by M, according to the relation:

$$\vec{B}_{ind}=f(\vec{d},RPM,M) \tag{1}$$

When a measurement of the magnetic field induced in the flywheel is carried out, the value of this measurement depends also on other quantities such as: the point in which the measurement is carried out, the characteristics of said first 1 and second 2 magnetic sensor, the surrounding environment, the type of gymnastic machine, the mechanical and electrical tolerance of the braking system S.

Therefore, for the purpose of measuring, the following relationship holds:

$$\vec{B}_{ind,mis}=f(\vec{d},RPM,M,T,\vec{x},S) \tag{2}$$

where T is the environmental temperature, $\vec{x}$ is the position $(x,y,z)^T$ of said first magnetic sensor 1 with respect to the magnetic brake, which also takes into account of the mechanical manufacturing tolerances, and S is a magnitude related to the surrounding space that takes account of the offset effects of factors external to the measuring system.

The relation (2) can be characterized numerically, under specific design conditions.

By varying the flywheel velocity RPM for different positions of the magnetic brake, it is possible to associate with each measured magnetic induction value $B_{ind,mis}$ (RPM, $\vec{d}$), a braking torque C, measured by the dynamometer.

In this way a data table or look-up table is obtained, which represents the analytical relationship between the variables under consideration (torque, velocity, magnetic induction), when the other elements are fixed:

magnetizing force $M_0$ of the reference magnetic brake,
nominal environmental temperature $T_0$,
nominal position $X_0$ of said first magnetic sensor 1,
reference environment $S_0$.

TABLE 1

| | $RPM_1$ | $RPM_2$ | ... | $RPM_g$ |
|---|---|---|---|---|
| $d_0$ | $(\vec{B}_i^{d0}, C_{0,1})$ | $(\vec{B}_i^{d0}, C_{0,2})$ | ... | $(\vec{B}_i^{d0}, C_{0,g})$ |
| $d_1$ | $(\vec{B}_i^{d1}, C_{1,1})$ | $(\vec{B}_i^{d1}, C_{1,2})$ | ... | $(\vec{B}_i^{d1}, C_{1,g})$ |

TABLE 1-continued

| | $RPM_1$ | $RPM_2$ | ... | $RPM_g$ |
|---|---|---|---|---|
| $d_2$ | $(\vec{B}_i^{d2}, C_{2,1})$ | $(\vec{B}_i^{d}, C_{2,2})$ | ... | $(\vec{B}_i^{d1}, C_{1,g})$ |
| ... | ... | ... | ... | |
| $d_n$ | $(\vec{B}_i^{dn}, C_{n,1})$ | $(\vec{B}_i^{dn}, C_{n,2})$ | ... | $(\vec{B}_i^{dn}, C_{n,g})$ |

As shown in the above Table 1, which is an example of look-up table, by varying the flywheel rotation velocity RPM and the magnetic brake position d, it is possible to associate a magnetic induction B torque, which corresponds to a braking torque value C.

Said look-up table is stored in a suitable storage support, which said control logic unit 5 is equipped with.

In an association phase, knowing the flywheel velocity rotation RPM detected by said angular velocity sensor 4 and reading a value of the magnetic field B, it is possible to know the associated braking torque C.

The look-up table can therefore be defined with respect a sample magnetic sensor 1 installed on a sample gymnastic machine in reference nominal controlled conditions, in a calibration phase.

For other magnetic sensors installed on gymnastic machines of the same type, the deviation of one or more of these parameters from the nominal conditions, for example during the construction of the exercise machine and/or during normal operating cycle, leads to the need to apply a correction to the detected value of the magnetic field B, so that it can be compared with the look-up table.

The measurement correction model is the following:

$$\vec{B}_{mis}^{d}=\alpha(T-T_0)\underline{u}+\vec{B}_{off}+Tr[\underline{x}-\underline{x}_0]\cdot(a\vec{B}_s^{d}+\vec{B}_i^{d}) \tag{3}$$

where $\alpha(T-T_0)\underline{u}$ is the correction temperature factor that takes into account the operating temperature T, with respect to the nominal temperature $T_0$ of the model, with $\alpha$ that represents the weakening factor or de-rating in temperature of the temperature sensor 3 and $\underline{u}$ is the unit versor of the reference system;

$\vec{B}_{off}$ is the environmental correction factor that takes into account the possible presence of magnetic noise in the environment, external to the measuring system;

$Tr[\underline{x}-\underline{x}_0]$ also called position offset value, is the linear transformation matrix that takes into account a possible displacement and/or rotation of said first magnetic sensor 1, according to detection axes, with respect to the nominal position $\underline{x}_0$;

$\vec{B}_S^{d}+\vec{B}_i^{d}$ is the magnetic induction value in nominal conditions, given by the vector resultant of two components: $\vec{B}_S^{d}$ static field in d position, it is a correction factor associated with the structural difference of the magnet-holder forks and then takes into account the mechanical structural differences between different gymnastic machines, in which there are different permanent magnetisation values, which occur in the calibration phase; $\vec{B}_i^{d}$ field induced by the rotation of the flywheel that generates the braking torque, when the magnetic brake is in d position;

a also called static magnetic offset, is the static field attenuation factor due to a different magnetization M, as previously described.

Figure 3:
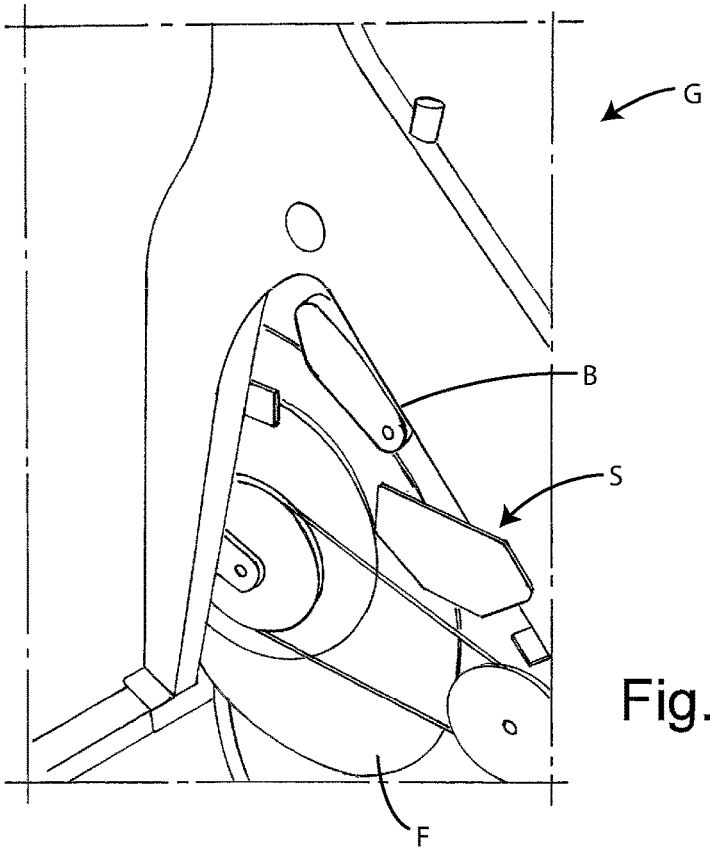
FIG. 3 shows a side view of a part of an gymnastic machine (G) having a flywheel (F), the gymnastic machine (G) having a brake system (S) according to the present disclosure, including magnetic brake (B), is installed thereon, in a rest position.
Figure 4:
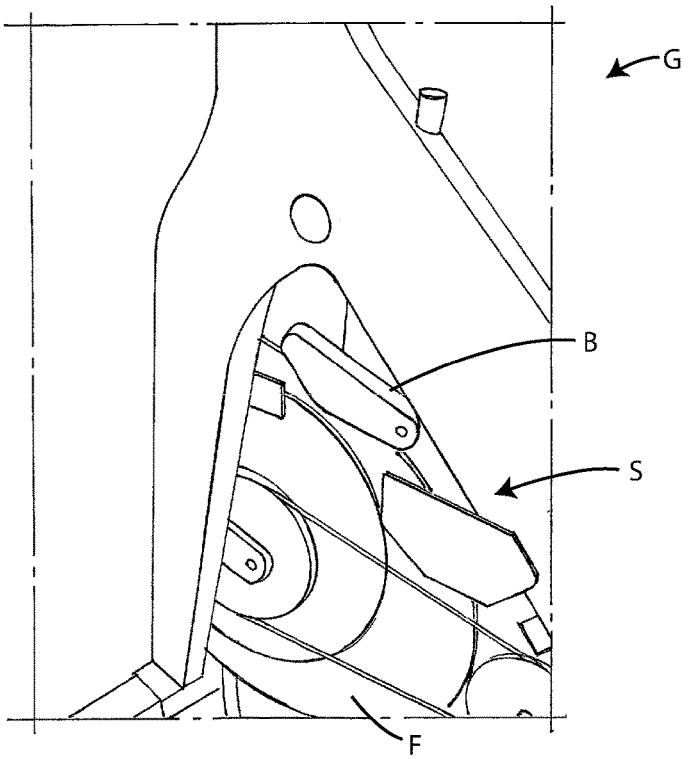
FIG. 4 shows a further side view of a gymnastic machine (G) having a flywheel (F), the gymnastic machine (G) having a brake system (S) according to the present disclosure, including magnetic bake (B), installed thereon, in an operating position.
Figure 5:
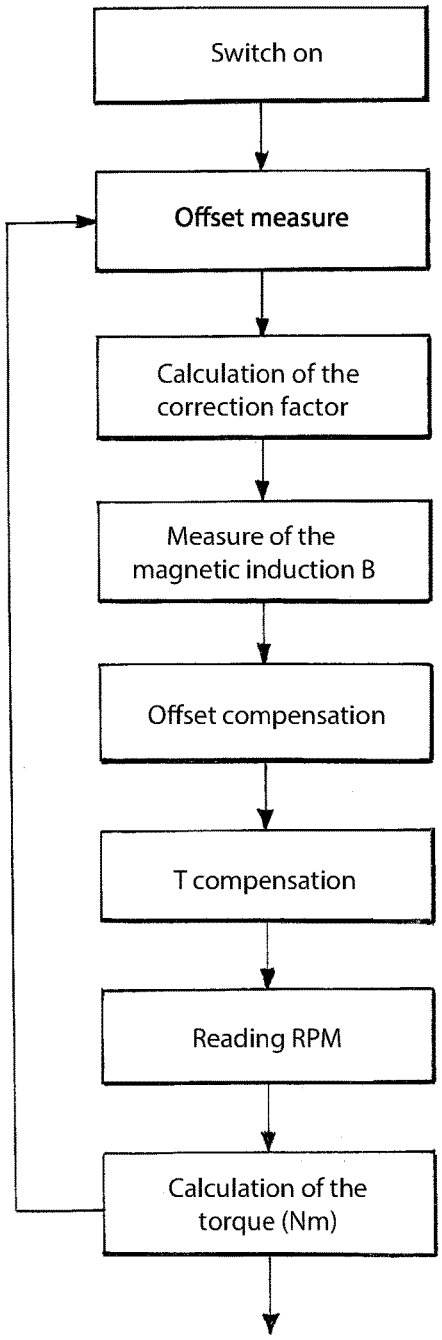
FIG. 5 shows a block diagram of the operating method of the braking system of the present invention.

The estimation of the parameters of the measurement correction model according to the equation (3) takes place in the following way (hereinafter reference is made in particular to FIG. 3).

Preliminarily, the temperature T is measured by said temperature sensor 3.

The de-rating factor $\alpha$ is characteristic of the magnetic sensor 1 used in accordance with the data of the datasheet.

Then, the external offset value $\vec{B}_{off}$ related to the environmental magnetic field by said second magnetic sensor 2 is measured.

In nominal conditions $\vec{B}_{off}=0$, the higher the environmental field, $\vec{B}_{off}$ increases in the amplitude accordingly.

Subsequently the position-offset value $Tr[\underline{x}-\underline{x}_0]$ in the test phase of the gymnastic machine is estimated, by two different speeds measures:

$$Tr[\underline{x}-\underline{x}_0]=\frac{\left(\vec{B}^d_{mis}(v_1)-\vec{B}^d_{mis}(v_2)\right)\cdot\left(\vec{B}^d_i(v_1)-\vec{B}^d_i(v_2)\right)^T}{\left\|\vec{B}^d_i(v_1)-\vec{B}^d_i(v_2)\right\|^2} \tag{4}$$

where:

$\vec{B}_{mis}{}^d(v_n)$ is the induced magnetic field measured at velocity $v_n$, with the magnetic brake in position d;

$\vec{B}_i{}^d(v_n)$ is the nominal induced field at velocity $v_n$, with the magnetic brake in position d, in accordance with the look-up table.

In nominal conditions, the transformation matrix coincides with the identity matrix Tr [ . . . ]=I.

Subsequently, the static magnetic offset value a is estimated in the test phase of the gymnastic machine, by a measurement with flywheel at rest.

In this case the induced field is zero, and it is obtained:

$$a=\frac{\left(Tr[\underline{x}-\underline{x}_0]\cdot\vec{B}^d_s\right)^T\cdot\left(\vec{B}^d_{mis}-\alpha(T-T_0)\underline{u}-\vec{B}_{off}\right)}{\left\|Tr[\underline{x}-\underline{x}_0]\cdot\vec{B}^d_s\right\|^2} \tag{5}$$

In nominal conditions, a=1.

Next, corrections are applied and a comparison with the look-up table is made.

The estimated parameters according to the formulas (4) and (5) during the testing phase of the gymnastic machine are stored in an appropriate storage support, which said control logic unit 5 is equipped with.

Said parameters, estimated according to the formulas (4) and (5), are used to correct the measurement of the magnetic field induced on the flywheel, detected during normal operation of the gymnastic machine, so as to calculate an actual value of the magnetic field induced on the flywheel by means of the formula:

$$\vec{B}_i{}^d=Tr^{-1}(\vec{B}_{mis}{}^d-\alpha(T-T_0)\underline{u}-\vec{B}_{off})-a\vec{B}_s{}^d \tag{6}$$

The operation of the braking system S described above is as follows.

When said braking system S is installed on a gymnastic machine, in particular on a spinning bike, the switching on of said braking system S is initially carried out.

Thereafter, said temperature sensor 1 carries out the measurement of the temperature T of the flywheel.

Said control logic unit 5 performs the calculation) of the temperature correction factor $\alpha(T-T_0)\underline{u}$.

Subsequently, said second magnetic sensor 2 carries out the measurement of the offset magnetic induction value $\vec{B}_{off}$.

Then, said control logic unit 5 reads the calibration data $T_r$ and a, and calculates the induced field $\vec{B}_i{}^d$ according to formula (6), said angular velocity sensor 4 performs the detection of the RPM velocity, said control logic unit 5 performs a comparison with the look-up table in the memory ($B_i{}^d$,RPM) in order to determine the braking torque value acting on the flywheel at that time, according to the RPM velocity data and the induced actual magnetic field on the flywheel, finally said logic control unit 5 calculates the power of the gymnastic machine associated to the actual braking magnetic force according to the following formula:

$$P=\frac{\text{Coppia}\cdot 2\pi\cdot RPM}{60}\,[\text{W}] \tag{7}$$

Subsequently, the measurements acquisition cycle is repeated from the temperature T measuring step.

As it is obvious from the above description, the system and method of the present invention allow to uniquely and universally measure the braking force of a magnetic brake installed on a flywheel of a gymnastic machine.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A magnetic braking system installable on a flywheel of an exercise bicycle, wherein magnetic braking members are arranged on said flywheel and are capable of generating a magnetic braking force on said flywheel, the magnetic braking system comprising:

a first magnetic sensor arranged proximate to said magnetic braking members for detecting an intensity of a magnetic field induced from said magnetic braking members on said flywheel;

an angular velocity sensor for measuring a rotation velocity of said flywheel;

a second magnetic sensor arranged at a predetermined distance between 5 and 15 cm from said first magnetic sensor and configured for detecting an effect of a frame of the exercise bicycle on the magnetic field induced on said flywheel;

a temperature sensor arranged in correspondence with said first magnetic sensor for detecting a temperature of said flywheel; and a control logic unit operatively connected to said first and second magnetic sensors, to said temperature sensor, and to said angular velocity sensor, wherein nominal calibration values are stored in said control logic unit, said control logic unit being capable of acquiring and processing electric signals from said first magnetic sensor, from said second magnetic sensor, from said temperature sensor, and from said angular velocity sensor, whereby said control logic unit is configured to calculate an actual magnetic braking force generated by said magnetic braking members on said flywheel during an operation of the exercise bicycle, wherein said actual magnetic braking force may be different from said magnetic breaking force, wherein said control logic unit is capable of correcting said calculation after a comparison between said storage nominal calibration values and data acquired from said first and second magnetic sensors, from said temperature sensor, and from said angular velocity sensor, and wherein the braking system is made on a printed circuit board having a shape which extends substantially longitudinally so that said first and second magnetic sensors are arranged at opposite ends of said printed circuit board at said predetermined distance.

2. The braking system according to claim 1, wherein said first and second magnetic sensors are Hall effect sensors.

* * * * *